US007566197B2

(12) United States Patent
Westendorf et al.

(10) Patent No.: US 7,566,197 B2
(45) Date of Patent: Jul. 28, 2009

(54) INDEPENDENT HYDRAULIC PINCHING FINGERS ATTACHMENT FOR UTILITY VEHICLES

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 408 days.

(21) Appl. No.: 11/222,642

(22) Filed: Sep. 9, 2005

(65) Prior Publication Data

US 2007/0059148 A1 Mar. 15, 2007

(51) Int. Cl.
*B66C 1/00* (2006.01)

(52) U.S. Cl. ..... 414/729; 294/88; 294/106

(58) Field of Classification Search ..... 414/729, 414/735, 739; 294/86.4, 87.1, 88, 104, 106, 294/107

See application file for complete search history.

(56) References Cited

U.S. PATENT DOCUMENTS

| | | | | |
|---|---|---|---|---|
| 2,326,338 | A | 8/1943 | Drott et al. | |
| 2,812,595 | A | 11/1957 | Drott et al. | |
| 3,077,999 | A | 2/1963 | Svoboda | |
| 3,243,905 | A | 4/1966 | Ulrich | |
| 3,342,357 | A * | 9/1967 | Larson | 414/731 |
| 3,344,540 | A | 10/1967 | Ulrich | |
| 3,422,975 | A * | 1/1969 | Crisp | 414/732 |
| 3,452,888 | A * | 7/1969 | Larson et al. | 414/552 |
| 3,455,477 | A | 7/1969 | Blair | |
| 3,512,665 | A | 5/1970 | Westendorf | |
| 4,030,625 | A | 6/1977 | Koehnen | |
| 4,085,856 | A | 4/1978 | Westendorf | |
| RE29,805 | E | 10/1978 | Koehnen | |
| 4,266,819 | A | 5/1981 | Pemberton | |
| 4,285,628 | A | 8/1981 | Jankowski | |
| 4,423,997 | A | 1/1984 | Pemberton | |
| 4,538,955 | A | 9/1985 | Langenfeld et al. | |
| 4,565,485 | A | 1/1986 | Wilman | |
| 4,566,844 | A | 1/1986 | Campin | |
| 4,606,692 | A | 8/1986 | Langenfeld et al. | |
| 4,787,811 | A | 11/1988 | Langenfeld et al. | |
| 4,907,356 | A | 3/1990 | Labounty | |
| 4,928,410 | A | 5/1990 | Walters et al. | |
| 4,930,974 | A | 6/1990 | Langenfeld et al. | |
| 5,073,080 | A | 12/1991 | Blum | |
| 5,094,581 | A | 3/1992 | Lamb | |
| 5,121,557 | A | 6/1992 | Moore | |
| 5,184,934 | A | 2/1993 | Gallo | |
| 5,398,983 | A * | 3/1995 | Ahrens | 294/106 |
| 5,516,174 | A | 5/1996 | Squyres | |
| 5,518,359 | A | 5/1996 | Pratt | |
| 5,544,435 | A | 8/1996 | Somero | |
| 5,564,885 | A | 10/1996 | Staben, Jr. | |
| 5,779,430 | A | 7/1998 | Ball | |
| 5,788,300 | A | 8/1998 | Dickison et al. | |
| 5,865,492 | A * | 2/1999 | Horton | 294/86.41 |
| 5,957,650 | A | 9/1999 | Rollo | |
| 5,997,237 | A | 12/1999 | Langenfeld et al. | |
| 6,176,531 | B1 * | 1/2001 | Wheeler | 294/88 |
| 6,308,440 | B1 | 10/2001 | Mueller | |
| 6,526,678 | B2 * | 3/2003 | Waddington, Jr. | 37/406 |

* cited by examiner

*Primary Examiner*—Donald Underwood
(74) *Attorney, Agent, or Firm*—Dowell Baker, P.C.

(57) ABSTRACT

The pinching fingers implement of the present invention provides independent grasping claws that can be independently opened or closed, and also independently rolled forward and backward, to provide for the secure and versatile grasping, manipulation and transport of irregular items.

19 Claims, 7 Drawing Sheets

FIG. 3
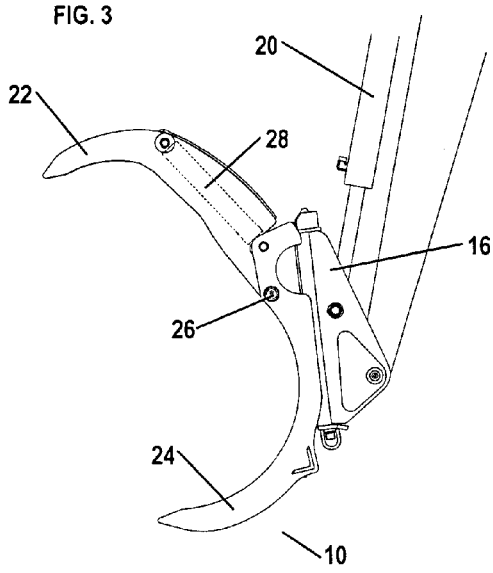
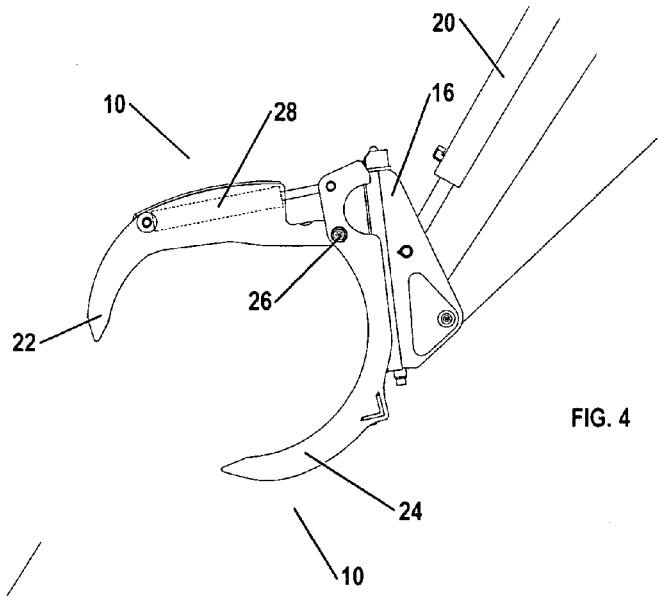
FIG. 4
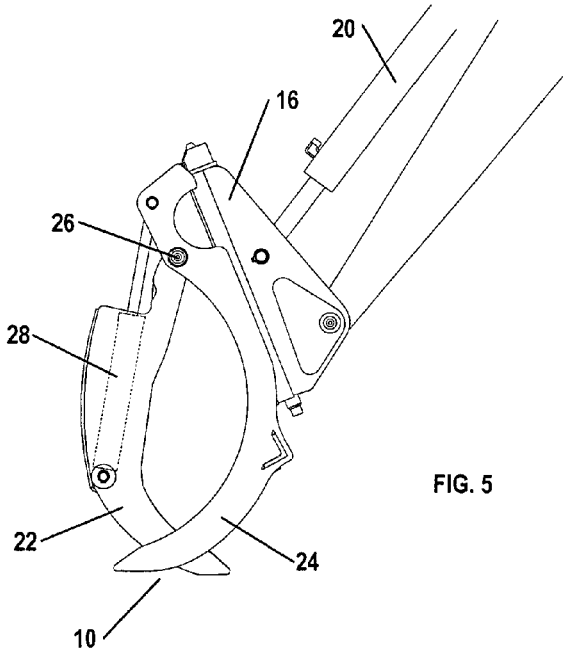
FIG. 5

INDEPENDENT HYDRAULIC PINCHING FINGERS ATTACHMENT FOR UTILITY VEHICLES

FIELD OF THE INVENTION

The present invention relates generally to implements for use with tractors, skid steers, backhoes and the like, and more specifically to a precise grasping and lifting attachment for use with such vehicles.

BACKGROUND OF THE INVENTION

Tractors and skid steers are common utility vehicles in the farming, construction and landscaping industries. The primary benefit of these vehicles is their great versatility and the wide variety of implements that can be attached to and used with the vehicle. After an initial investment in a tractor or skid steer, owners of these vehicles can add increased functionality by purchasing a wide variety of specialized implements including loaders, backhoes, blades, post hole diggers, forks and bale spears, to name a few. Because of the ubiquity and great versatility of tractors and skid steers, owners of these vehicles continuously seek new and improved implements to perform specialized tasks.

Grappling jaws are good examples of implements that are especially useful for performing specialized tasks. These implements are essentially large, heavy-duty jaws that can be opened and closed around material so that the material may be grasped, lifted and transported by the vehicle. Because these implements can be closed around the material or item, these implements expand the lifting and carrying capabilities of the utility vehicle.

Grappling jaws of various configurations have been developed for use with front end loaders and skid steers. In their most common form, grappling jaws have been adapted for use with the conventional loader bucket of these vehicles. For example, as shown in U.S. Pat. Nos. 5,094,581 and 5,957,650, the grappling jaw is attached to the bucket so that the jaw may be closed over the bucket to secure material being carried in the bucket. The grappling jaw is typically controlled by a hydraulic piston or multiple pistons that open and close the jaw relative to the bucket. Such grappling jaws can significantly increase the carrying capacity of the bucket and are useful for securing and controlling loose material carried in the bucket, as well as large, regularly shaped items such as hay bales.

Grappling jaws in this configuration, however, suffer many limitations. In particular, the bucket and grappling jaw combination is not well suited for highly precise grasping tasks. First, the bucket must be inserted beneath an item before the upper grappling jaws may be used to grasp the item. For items that are embedded in the ground, this is often not possible. Also, for irregular items or items that are laying at an angle to the ground, it is often difficult if not impossible to place the bucket securely against an item prior to grasping the item. The sides of the bucket also often impair the ability of the implement to grasp and carry items longer than the width of the bucket.

The weight of the bucket itself in these grappler configurations is also a significant disadvantage. Every utility vehicle has a maximum weight that it can effectively lift, handle and transport. The weight of the bucket must, of course, be included in this maximum weight capacity and, the heavier the bucket, the lower the lifting capacity of the vehicle.

In addition, the bucket often obscures the visibility of the operator, making it difficult for the operator to use the bucket and grappling jaw to grasp and carry certain items.

Grappling jaws with opposing tines or claws that interlock when closed have been developed that attempt to overcome some of these limitations. These implements, often referred to as grapple rakes, utilize a second set of tines or claws in place of the lower bucket to provide opposing claws that are better suited for grasping certain objects. For example, U.S. Pat. No. 6,098,320 discloses grappling jaws useful for dislodging and grasping large stones embedded in the ground. These grappling jaws include a lower set of tines that may be inserted in the ground beneath a stone and an upper set of tines that may then be closed around the stone. Opposing grappling jaws with an upper and lower set of tines are also disclosed in U.S. Pat. Nos. 6,176,531 and 6,601,891.

Although useful for certain tasks, these grapple rakes are not well suited for highly precise grasping tasks or for lifting and carrying irregularly shaped items such as fallen trees and brush. To provide structural stability and strength, the upper and lower sets of claws on these prior art grapple rakes are typically constructed as unified or solid pieces that clamp in opposition on another. When grasping an item of uniform cross section, or material that may be easily crushed between the opposing jaws, these designs are adequate for securing the item.

However, when a solid item to be grasped has a tapered or irregular cross section, one claw may be restricted from closing on the item when the other claw closes on a larger portion of the item, causing the item to be held by only one claw and not the other. In this instance, the item cannot be safely transported without the danger of the item moving and shifting during transport.

To address this problem, grappling implements have been developed with upper fingers that may be closed independently of one another. For example, Bobcat Company offers Industrial Grapple and Industrial Fork Grapple implements with two sets of upper claws that may be closed independently of one another. Worksaver, Inc. also offers a Split-Top Grapple Rake with dual upper grapples that may also be closed independently of one another. Although these implements do provide increased control over bulky and irregularly shaped items, they do not offer the precision and control necessary for many tasks. In particular, these configurations do not provide a grasping implement that can be precisely placed around irregular items or obstructions and easily controlled by the operator for grasping and lifting irregular items.

Such features are especially useful for clearing fallen trees, branches and brush. Clearing such items presents specific challenges for the operator and the construction of the grasping implement. First, operator visibility and precise control are essential for precise placement of the fingers through limbs and branches prior to closing the fingers. Second, high strength of the fingers is essential so that smaller branches and brush may be crushed between the fingers. Third, the hydraulic cylinders and lines must be protected from damage from branches and limbs during operation. Thus, a grappling implement adapted for clearing fallen trees, branches and brush must offer high visibility, precise control, high clamping strength and protection for the hydraulic components.

Accordingly, an object of the present invention is to provide pinching fingers for a tractor, skid steer or the like that may move and grasp independently so that both claws can be used to grasp and safely transport irregularly shaped items such as fallen trees and brush.

An additional object of the present invention is to provide a grasping implement that does not obscure the visibility of the operator and provides precise control so that highly precise grasping operations may be performed.

Also, an object of the present invention is to provide pinching fingers with high clamping strength.

Another object of the present invention is to provide pinching fingers that protect the hydraulic cylinders and lines used to control the fingers.

A further object of the present invention is to provide pinching fingers that are easy to install and remove on a conventional loader or skid steer.

Yet another object of the present invention is to provide pinching fingers that can be quickly interchanged with other implements on a conventional loader or skid steer.

A still further object of the present invention is to provide a pinching fingers attachment with sufficient structural stability and strength to grasp, lift and transport heavy items including logs, trees and other items.

Still another object of the present invention is to provide an improved vehicle with a pinching fingers attachment.

Another object of the present invention is to provide a backhoe with a single set of claws.

A further object of the invention is to provide a loader or skid steer with pinching fingers that are simple and easy to operate.

Finally, an object of the present invention is to provide a pinching fingers attachment that is economical to manufacture, durable and refined in appearance.

SUMMARY OF THE INVENTION

The preferred embodiment of the present invention provides a pinching fingers implement that can be used with conventional tractors, skid steers and other vehicles with arms for operating implements. Two independent sets of claws are attached to the end of each of the arms of the tractor or skid steer. In this position, the pinching fingers can be raised and lowered like a typical implement. The pinching fingers may also be rolled forwards and backwards for precise placement of the fingers prior to grasping and for precise release of item being lifted and transported. Finally, the pinching fingers may be opened and closed to securely grasp an item being grasped and transported.

The left and right claws may be opened or closed independently of one another with separate hydraulic cylinders operated by separate hydraulic controls. In this embodiment, maximum versatility and control of the pinching fingers is obtained. In the preferred embodiment, however, the left and right claws are opened and closed in unison with separate hydraulic cylinders operated by a single set of hydraulic controls. In this configuration, the left and right claws may still be moved independently of one another (as discussed below) for precise placement of the fingers prior to grasping and secure grasping of an irregular item after placement. This configuration provides for ease of operation without significant loss of the ability to precisely control the fingers.

The independent pinching fingers of the present invention may be provided in various configurations. First, the bottom two pincer claws may be tied together with a lower stabilizer bar. In this configuration, the lower stabilizer bar provides increased stability and strength for the pinching fingers.

Alternatively, the lower stabilizer bar may be omitted. In this configuration, the bottom pincer claws will still operate in unison when not obstructed. However, when faced with an obstruction, the bottom pincer claws remain capable of independent movement because the hydraulic cylinders that control the forward and backward roll of the fingers are connected in series. Thus, when the fingers are rolled backward and one bottom pincer claw meets an obstruction that stops its movement, the other bottom pincer claw may continue to roll backward until it also meets an obstruction. This feature allows for precise and secure placement of the bottom pincer claws on an irregularly shaped item prior to grasping by the upper pincer claws.

The upper pincer claws may also be tied together with an upper stabilizer bar. Preferably, however, the upper pincer claws are not connected so that they may more freely close independently. The upper pincer claws are controlled by hydraulic cylinders connected in series that open and close the upper pincer claws relative to the bottom pincer claws. When operated without obstruction, the upper pincer claws move in unison. However, when grasping an item with an irregular cross section, one the upper pincer claws will typically close upon and secure a larger portion of the item before the other upper pincer claw. Because the hydraulic cylinders controlling the upper pincer claws are connected in series, the other upper pincer claw will continue to close until it also secures the smaller portion of the irregular item. This feature allows for irregularly shaped items, in particular tree trunks, branches and limbs, to be securely grasped, lifted and moved with the pinching fingers of the present invention.

The pinching fingers of the present invention offer many advantages over prior art grappling implements. As previously noted, the four claws may all be operated independently, allowing for greater flexibility and versatility in grasping, securing, lifting and transporting irregular items. The pinching fingers are also light in weight, which increases the lifting capacity of the utility vehicle. The pinching fingers also grasp and hold items closer to the utility vehicle than conventional bucket and grappling jaw configurations, which further increases the lifting capacity of the vehicle.

The open configuration of the pinching fingers of the present invention also provides greater visibility, allowing for precise placement and operation of the fingers. The pinching fingers may also more easily be inserted though and around obstacles, which allows the fingers to be placed at the most advantageous lifting point, allowing items to be picked up regardless of the surrounding obstacles. The pinching fingers may also lowered directly around an item from above, rather than from the side, as with conventional grappling implements. This allows items to be picked up from above rather than scooped up from below, further enhancing the versatility of the present invention.

The pinching fingers of the present invention also provide high clamping strength so that brush and smaller limbs may be crushed between the fingers. The hydraulic cylinders and lines of the present invention are also located inside the upper fingers of the implement, thereby protecting these critical components during operation. The pinching fingers are easy to install and remove on a conventional tractor or skid steer and can be easily attached using conventional pins and bolts. Alternatively, a standardized quick release system may be used so that the pinching fingers may be even more quickly interchanged with other implements adapted for the quick release system.

The pinching fingers of the present invention are especially useful for transporting logs and clearing brush. The pinching fingers can be clamped around a log so that the log cannot roll when it is picked up, transported and unloaded, increasing the safety of working with large logs. The pinching fingers can also be clamped around irregularly shaped items such as fallen trees or heavy farm equipment, making it easier to lift and move such items than with prior art implements. In addition, the pinching fingers can be inserted into the ground to grasp and remove items embedded in or attached to the ground such as rocks, loose pavement, dislodged stumps and ground cover.

The pinching fingers of the present invention have also been adapted for use with skid steers having a coupler plate for attaching implements to the skid steer, as well as for use with a backhoe, as described below.

These and other advantages will become apparent as this specification is read in conjunction with the accompanying drawings and appended claims.

BRIEF DESCRIPTION OF THE DRAWINGS

FIG. 3 is a side view of a front end loader with the pinching fingers of the present invention in a fully open position.

FIG. 4 is a side view of a front end loader with the pinching fingers of the present invention in an intermediate position.

FIG. 5 is a side view of a front end loader with the pinching fingers of the present invention in a fully closed position.

FIG. is a perspective view of the pinching fingers of the present invention showing the fully independent movement of both the top and bottom claws.

Figure 9:
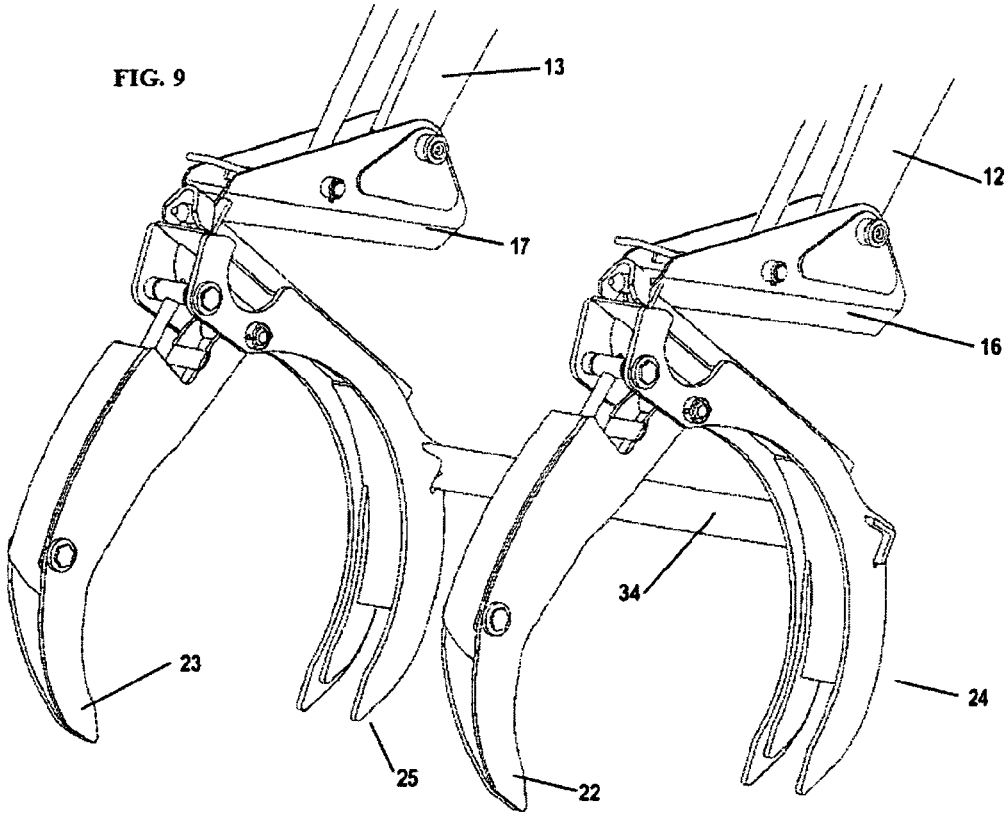

FIG. 9 is a front perspective view of the pinching fingers of the present invention showing a quick release mechanism for attachment of the pinching fingers to a utility vehicle.

Figure 10:
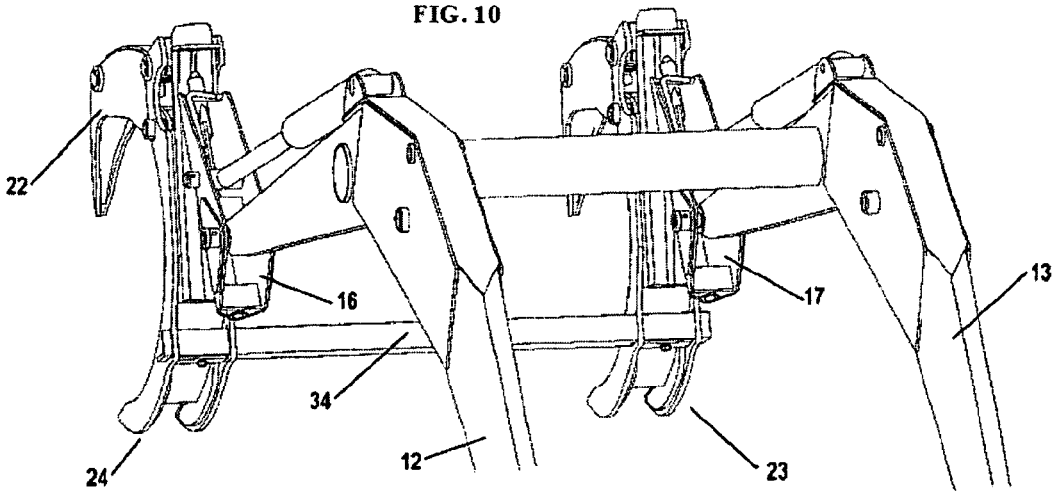

FIG. 10 is a rear perspective view of the pinching fingers of the present invention showing a quick release mechanism for attachment of the pinching fingers to a utility vehicle.

Figure 11:
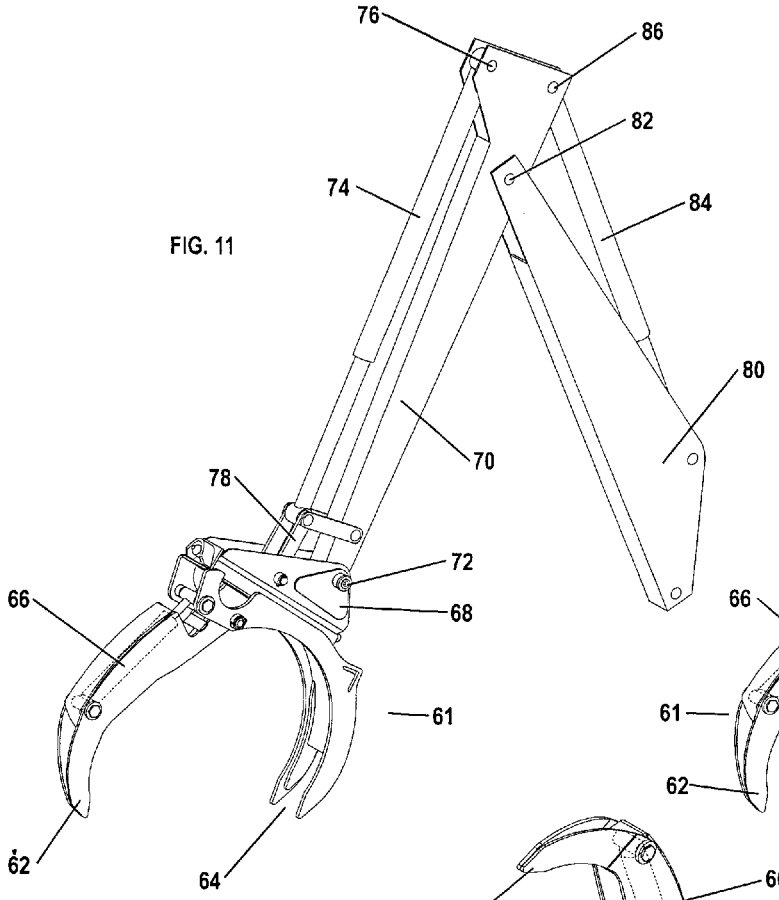

FIG. 11 is a perspective view of a single set of claws of the pinching fingers of the present invention attached to a backhoe.

Figure 12:
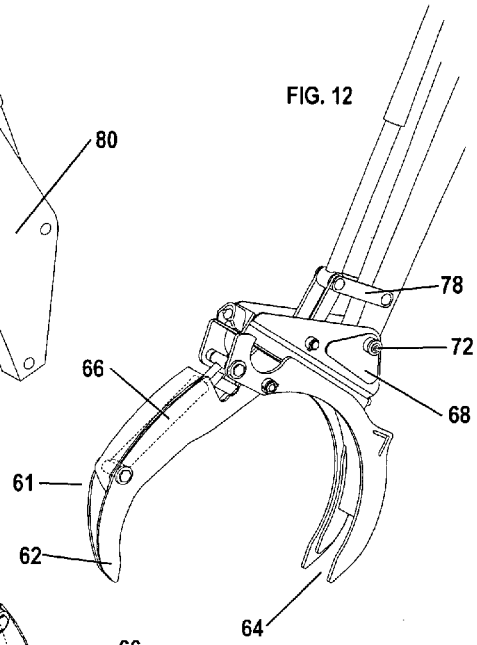

FIG. 12 is a closer perspective view of a single set of claws of the pinching fingers of the present invention attached to a backhoe.

Figure 13:
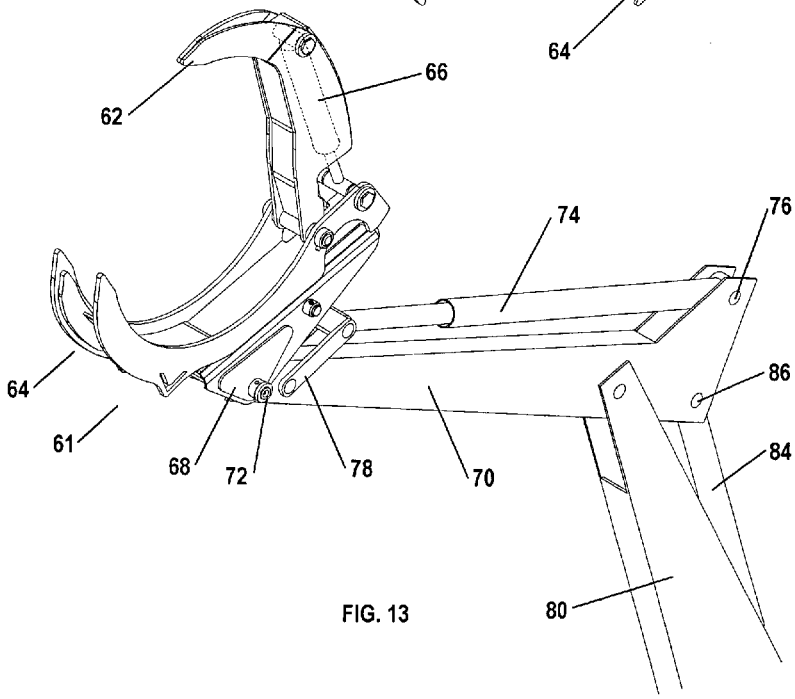

FIG. 13 is a perspective view of a single set of claws of the pinching fingers of the present invention attached to a backhoe and showing the capability of rotation of the claws.

The drawings are not necessarily to scale and certain details unnecessary for an understanding of the present invention have been omitted. The invention is not limited to the particular embodiments illustrated herein.

DETAILED DESCRIPTION

The present invention may be used with any vehicle having an arm or arms for raising and lowering, and also rolling forward and backward, an implement. Although the preferred embodiment of the present invention is intended and adapted for use with a loader or skid steer, those of skill in the art will recognize that the present invention is equally adaptable for use with other utility vehicles. However, for descriptive purposes, the present invention will be described in use on a tractor and/or skid steer. Another embodiment of the present invention is intended for use with a backhoe.

Figure 1:
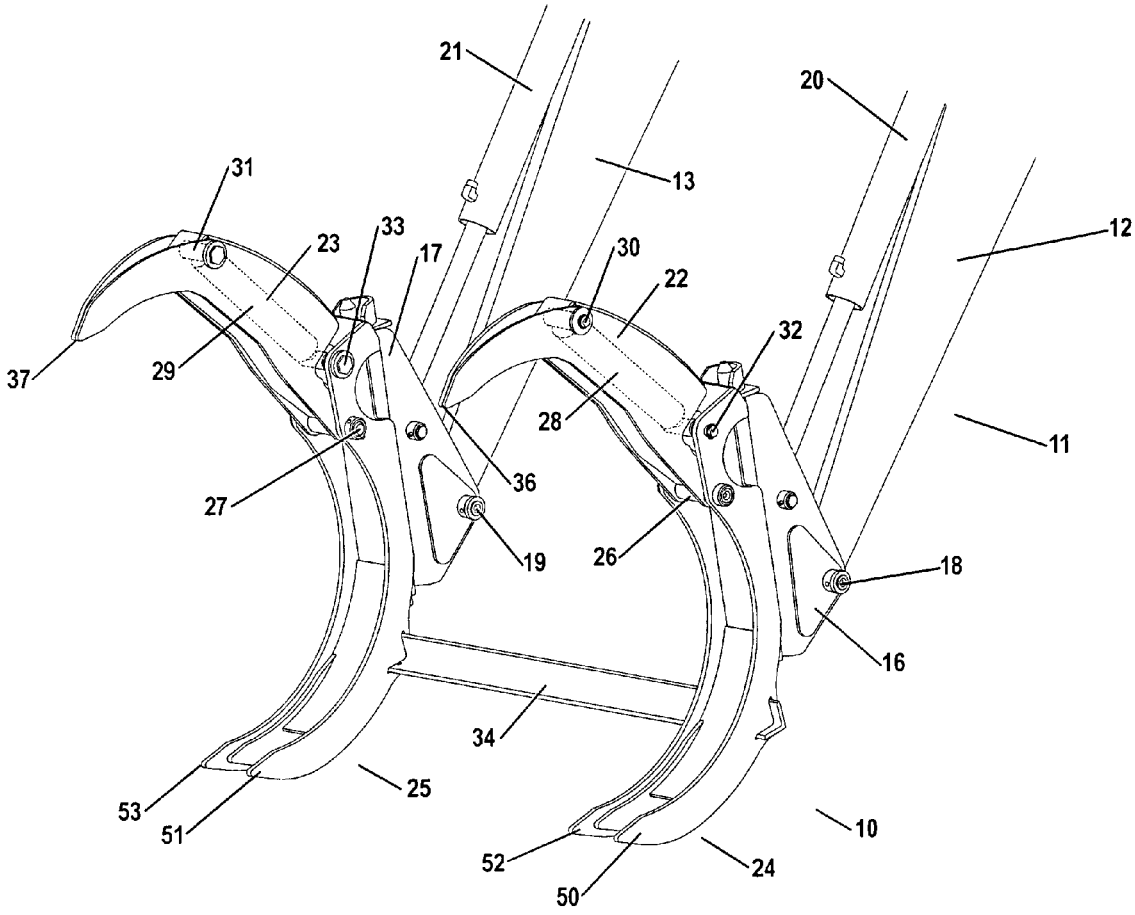
FIG. 1 is a perspective view of a front end loader with the pinching fingers of the present invention.

FIG. 1 shows the pinching fingers 10 of the present invention attached to a front end loader 11. The front end loader 11 includes a left arm 12 and a right arm 13 that are raised and lowered by a left lift cylinder and the right lift cylinder (not shown). The front end loader 11 also includes a left coupler 16 attached to the left arm 12 at the left coupler pivot point 18 and a right coupler 17 attached to the right arm 13 at the right coupler pivot point 19 so that the couplers rotate about the respective coupler pivot points. The couplers 16 and 17 are also attached to the left coupler cylinder 20 and the right coupler cylinder 21 which rotate the couplers backward and forward about the coupler pivot points.

The pinching fingers 10 include a left top pincer claw 22, a right top pincer claw 23, a left bottom pincer claw 24 and a right bottom pincer claw 25. The left bottom pincer claw is comprised of two tines 50 and 52 and the right bottom pincer claw is comprised to two tines 51 and 53. The left bottom pincer claw 24 is attached to the left coupler 16 and the right bottom pincer claw 25 is attached to the right coupler 17. The bottom pincer claws 24 and 25 may be fixedly attached to the couplers 16 and 17, but are preferably attached to the couplers by quick connect means (described below in connection with FIGS. 9 and 10) that allow the pinching fingers to be quickly replaced with other front end loader implements.

The top pincer claws 22 and 23 are attached to the bottom pincer claws 24 and 25 at the pincer claw pivot points 26 and 27. A left pincer claw cylinder 28 is enclosed within the left top pincer claw 22 and a right pincer claw cylinder 29 is enclosed with the right top pincer claw 23. The pincer claw cylinders 28 and 29 are attached to the top pincer claws 22 and 23 at the top pincer claw cylinder connection points 30 and 31 and attached to the bottom pincer claws 24 and 25 at the bottom pincer claw cylinder connection points 32 and 33. The pincer claw cylinders 28 and 29, as will be described more fully below, operate to open and close the top pincer claws 22 and 23 relative to the bottom pincer claws 24 and 25.

Figure 6:
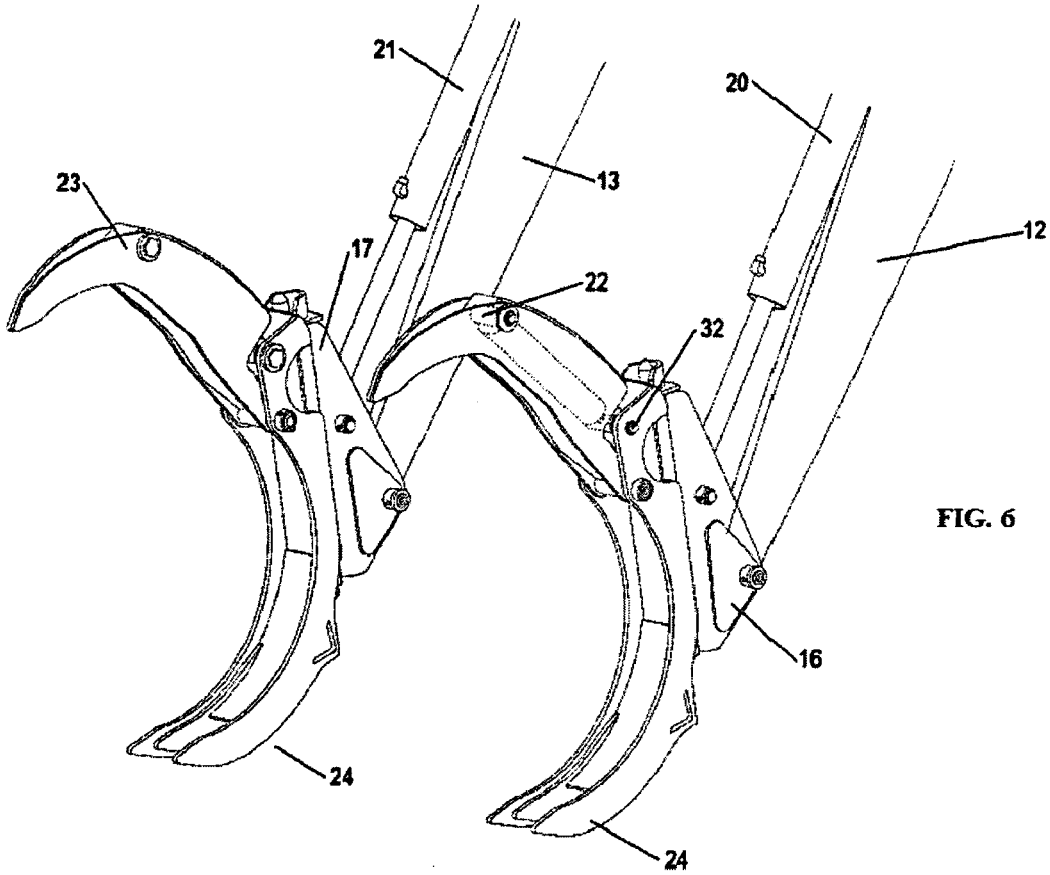
FIG. 6 is a perspective view of the pinching fingers of the present invention without a lower stabilizer bar, thus allowing for fully independent movement of the lower claws relative to one another.
Figure 7:
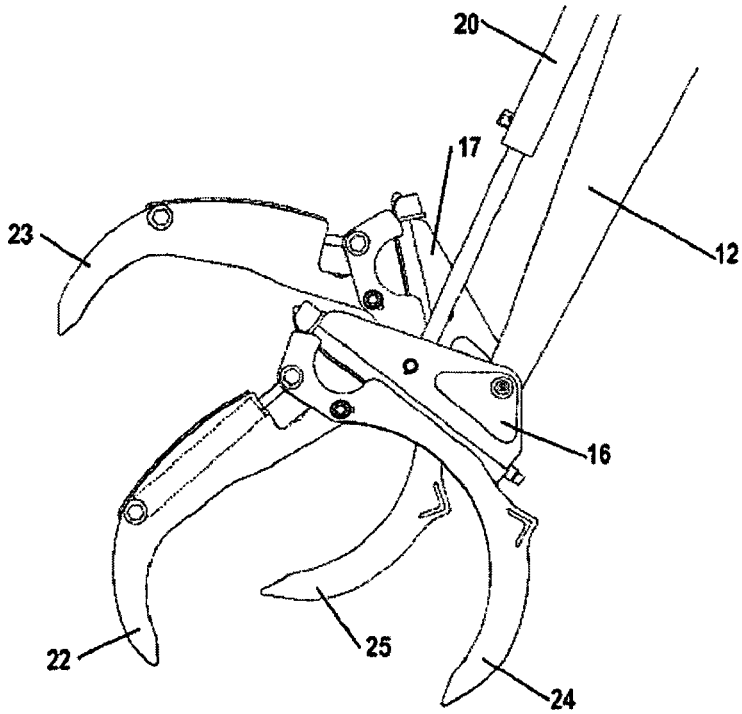
FIG. 7 is a side view of the pinching fingers of the present invention showing the fully independent movement of both the ton and bottom claws.
Figure 8:
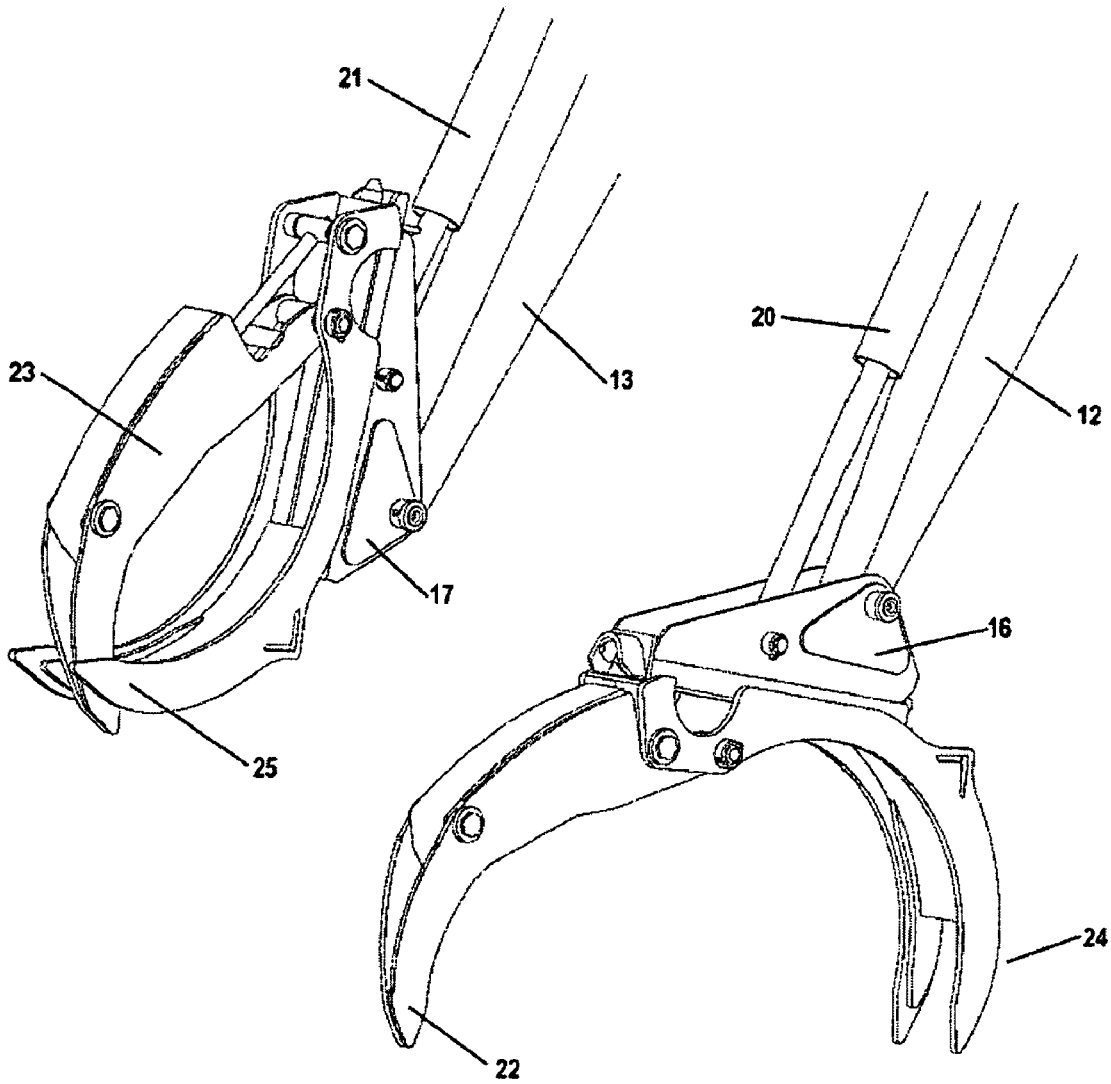

The bottom pincer claws 24 and 25 may be connected with a lower stabilizer bar 34 that is fixedly connected at each end to the bottom pincer claws, as shown in FIG. 1. As will be described more fully below, the lower stabilizer bar 34 provides increased stability and strength for the pinching fingers. However, for increased precision and control of the bottom pincer claws, the lower stabilizer bar may be omitted, as shown in FIGS. 6-8. A removable lower stabilizer bar may also be provided that is attached to the bottom pincer claws when increased stability is required but removed when increased precision and control is desired. An upper stabilizer bar (not shown) may also be provided, but would typically not be included due to the desirability of fully independent movement of the top pincer claws.

Figure 2:
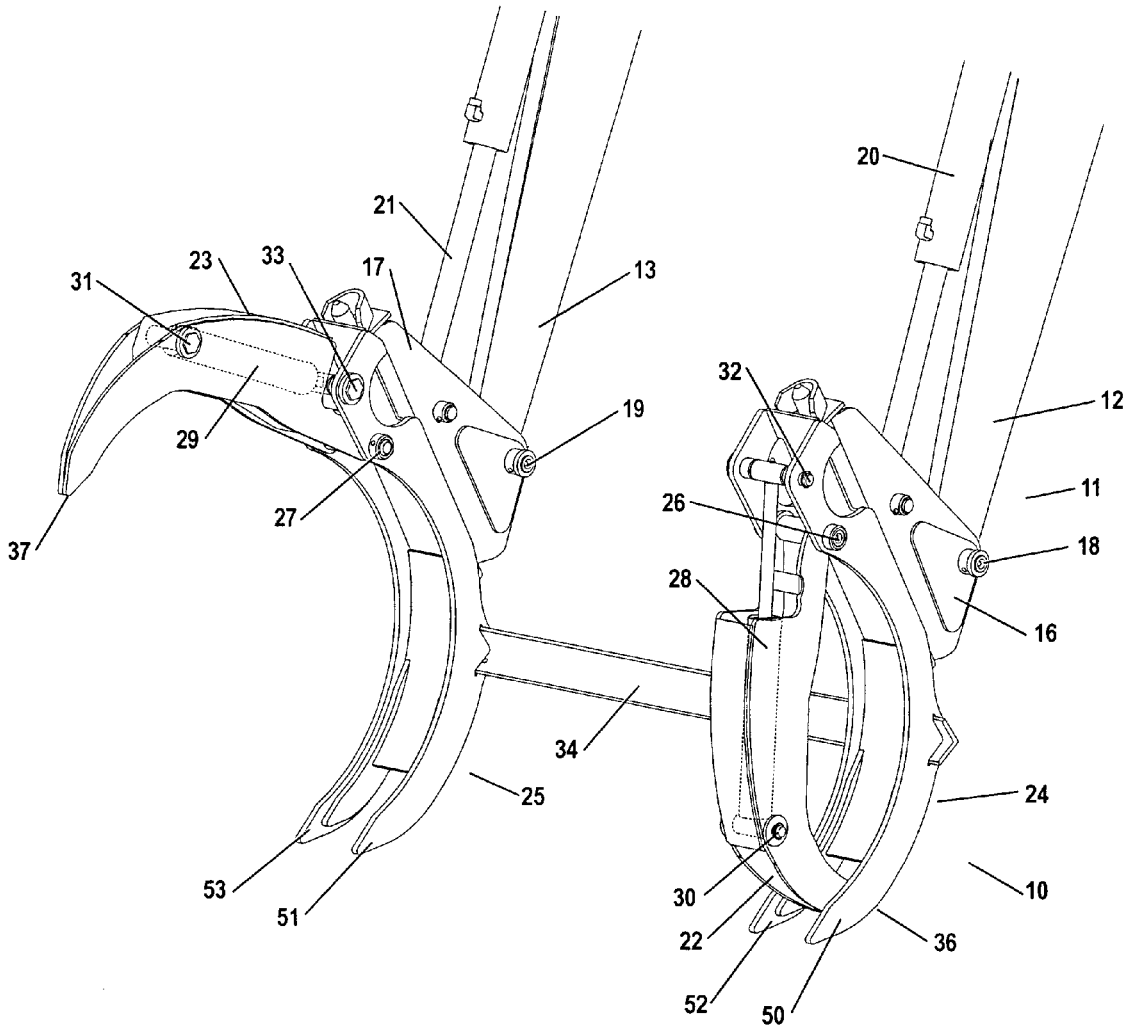
FIG. 2 is a perspective view of a front end loader with the left claws (shown on the right side of the drawing) of the pinching fingers in a closed position and the right claws of the pinching fingers in an open position.

The top pincer claws 22 and 23 are preferably comprised of flat metal plates that are spaced apart to provide an enclosure for the pincer claw cylinders 28 and 29 but taper towards one another and are welded together at the tips 36 and 37 of the claws. The bottom pincer claws 24 and 25 are preferably comprised of flat metal plates that remain spaced apart at the tips of the claws. In this configuration, the top pincer claws 22 and 23 insert through the bottom pincer claws 24 and 25 when the pinching fingers are closed, as shown in FIG. 2. In FIG. 2, the left claw is in a fully closed position with the tip 36 of the left top pincer claw 22 inserted through the left tines 50 and 52 of the left bottom pincer claw 24. As the claws are closed to the fully closed position, the curvature of the claws serve to draw an item into the claws and closer to the utility vehicle. This feature further increases the lifting capacity of the utility vehicle because the item is held as close as possible to the vehicle, reducing the lifting moment created by the weight of the item.

The pinching fingers 10 are raised and lowered by the lift cylinders (not shown). The coupler cylinders 20 and 21 roll the pinching fingers 10 forward and backward by rotating the couplers 16 and 17 to which the bottom pincer claws 24 and 25 are attached. As shown in FIGS. 3-5, the pincer claw cylinder 28 opens and closes the pinching fingers 10 by causing rotation of the top pincer claw 22 about the pincer claw pivot point 26.

In FIG. 3, the pinching fingers 10 are shown in the fully open position. By extending the pincer claw cylinder 28, as shown in FIG. 4, the top pincer claw 22 is rotated about the pincer claw pivot point 26 to close relative to the bottom pincer claw 24. With the pincer claw cylinder 28 fully extended, as shown in FIG. 5, the pinching fingers 10 are fully closed.

The coupler cylinders 20 may be controlled with independent hydraulic controls, but are conventionally controlled in unison by the same hydraulic controls. The coupler cylinders are conventionally and preferably connected in series so that, if the movement of one cylinder is restricted, power is transferred to the other cylinder. This feature allows for independent movement of the left and right pinching fingers.

With the lower stabilizer bar 34 connecting the bottom pincer claws 24 and 25, the independent movement of the left and right pinching fingers is limited, providing increased stability for the pinching fingers. However, due to flexing of the bar, some independent movement remains possible. With the lower stabilizer bar 34 omitted or removed, as shown in FIG. 6, independent movement of the left and right pinching fingers is provided for increased control and more precise placement of the pinching fingers when grasping irregular items such as a fallen tree.

When grasping such an item, the open pinching fingers may be rolled backward until one of the bottom pincer claws comes into contact with the fallen tree. The coupler cylinders will continue to roll the other bottom pincer claw backward because power is transferred from the obstructed claw to the unobstructed claw. This feature is shown in FIG. 7 which illustrates the position of the claws with the right pincer claws 23 and 25 rotated farther backwards than the left pincer claws 22 and 24. When the unobstructed claw also comes into secure contact with the fallen tree, the upper top pincer claws 22 and 23 may be closed around the tree to securely grasp it.

The left and right pincer claw cylinders 28 and 29 may also be controlled with separate hydraulic controls. In this configuration, the pinching fingers may be freely opened and closed at will, which provides some measure of increased flexibility in certain operations. The left and right pincer claw cylinders 28 and 29 are preferably, however, connected in series so that the pincer claw cylinders, like the coupler cylinders, may transfer power to one another when one of the top pincer claws 22 or 23 is obstructed.

This feature is particularly useful for grasping irregular items, and provides a key benefit over prior art grasping implements. As the pinching fingers are closed, one of the top pincer claws 22 or 23 will come into contact with the item being grasped. The pincer claw cylinders 28 and 29 will continue to close the other top pincer claw because power is transferred from the obstructed top pincer claw to the unobstructed top pincer claw. When the unobstructed claw also comes into secure contact with the irregular item, the item will be securely held in the pinching fingers. Thus, as shown in FIG. 8, the left and right claws may be rotated separately and also closed separately to provide the greatest versatility for precise placement and secure grasping of the implement.

This feature allows for secure grasping of an irregular item before the item is ever moved. By contrast, prior art grappling implements must typically lift or move an irregular item in order to get a secure grasp on the item. With large, cylindrical objects, such as logs, large pipes or culverts, this lifting or movement could cause the item to roll or shift, which increases the danger of working with such items. The pinching fingers of the present invention may securely grasp an item prior to lifting or moving the item, which greatly increases the safety and precision of moving certain items.

The configuration and features of the present invention provide many other advantages over prior art grappling implements. The open space between the fingers allows an operator a clear view of an item to be grasped and transported. With this open space and clear view, the pinching fingers can be precisely placed on an item, even if the item is located among other items or obstacles. The present invention may precisely pick an item from a point no wider that either of the fingers. By contrast, a bucket and grappling jaw combination requires an open space at least as wide as the width of the bucket for the implement to be used. Also, when grasping a fallen tree, the pinching fingers can be precisely placed among and between branches in the precise location needed to securely grasp the tree. Such precise placement is not possible with prior grapple rakes, making them less desirable for working with trees and brush.

The present invention is also particular useful for lifting and moving farm and tractor implements, industrial items such as welding jigs and even carts. One would not even consider moving such items with conventional grappling implements. Farm and tractor implements, which are often stored outside on the ground, must typically be moved by reconnecting the implement to a vehicle, which can be a time consuming and troublesome task. The pinching fingers of the present invention can be gently placed on such irregular and bulky items so that the item can be quickly moved. This ease of movement allows, for example, an operator to move an item, quickly mow grass where the item was located, and then return the item to its previous location.

The light weight of the pinching fingers of the present invention is also a great advantage. Conventional grappling implements can weigh as much as 800 to 1,000 pounds. The weight of the pinching fingers described herein is only approximately 320 pounds. Thus, the lifting capacity of a vehicle can be increased approximately 500 to 700 pounds through the use of the present invention. In addition, the present invention holds a payload closer to the vehicle as compared to other grappling implements, further increasing the lifting capacity of a vehicle using the pinching fingers described herein.

The pinching fingers of the present invention are preferable connected to a utility vehicle using a quick connect system as shown in FIGS. 9 and 10. This quick connect system allows the pinching fingers of the present invention to be quickly installed and removed on the utility vehicle.

Although the bottom pincer claws 24 and 25 may be attached to separate couplers as shown in FIG. 1, the bottom pincer claws may also be attached to a coupler plate as is found on many skid steers (not shown). In this configuration, the coupler plate, and in turn the pinching fingers, may be rolled forward and backward by a single hydraulic cylinder attached to the coupler plate, or multiple hydraulic cylinders attached to the coupler plate. Although this configuration necessarily ties the bottom pincer claws together for uniform movement and increased stability, the operation of the pinching fingers of the present invention remains essentially unchanged. Alternatively, the top pincer claws may be attached to a coupler plate and the bottom pincer claws controlled by hydraulic cylinders to open and close the claws. The inventors of the present invention contemplate these and other alternative configurations of the present invention.

As shown in FIGS. 11-13, a single set of claws of the pinching fingers of the present invention may also be used with a backhoe. A backhoe is primarily designed for digging and includes a bucket that may be rotated forward and backward, moved forward and backward, raised and lowered and rotated laterally. With the bucket replaced by a single set of claws, these same powered movements may be used to operate an effective and versatile grappling implement.

As shown in FIG. 11, a single set of claws 61 including a top claw 62 and a bottom claw 64 have been attached to a backhoe 60 in place of the conventional bucket. A closer view of the single set of claws 61 is shown in FIG. 12. The top claw 62 may be opened and closed relative to the bottom claw 64 by the pincer claw cylinder 66 in the same manner as described above.

The bottom claw 64 is connected to a coupler 68 that is in turn connected to the first arm 70 at the pivot point 72. A rotation cylinder 74 is also connected to the first arm 70 at the connection point 76 and the coupler 68 through the linkage 78. The first arm 70 is connected to a second arm 80 at the connection point 82. A lift cylinder 84 is connected to the first arm 70 at the connection point 86.

Thus, upon activation of the rotation cylinder 74, the coupler 68 and the single set of claws 61 connected to the coupler 68 may be rotated forward and backward. Upon activation of the lift cylinder 82, the claws 61 may be raised and lowered. As shown in FIG. 13, the claws 61 have been rotated backward by retraction of the rotation cylinder 74 and lifted by retraction of the lift cylinder 84. Upon activation of lateral rotation cylinders (not shown), the claws 61 may be also be rotated laterally left and right. The claws 61 may also be opened and closed by a pincer claw cylinder 66 enclosed in the top claw 62.

When attached to a backhoe as shown in FIG. 11-13, the single set of claws offers many advantages. The wide range of movement of the backhoe and the high strength and light weight of the claws allow for extremely precise yet powerful grasping and lifting operations. The light weight of the claws allows for very heavy items to be manipulated and moved by the backhoe. Cumbersome and awkward items may be easily moved, manipulated and precisely placed with the backhoe. Buildings and structures may also be effectively and precisely demolished with individual items easily sorted and picked from the rubble upon demolition. In summary, the backhoe grappling implement of the present invention offers advantages and opportunities for use heretofore unknown to any utility vehicle implement.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

What is claimed is:

1. An implement capable of attachment to a utility vehicle having a first boom, a second boom, at least one lift cylinder for raising and lowering the booms and at least one coupler cylinder for rotating the implement forward and backward, the implement comprising:

a first pair of pinching fingers comprising a first top pincer claw, a first bottom pincer claw and a first pincer claw cylinder connected to the first top pincer claw and the first bottom pincer claw, the first pincer claw cylinder distant from both the first boom and the second boom, the first top pincer claw being rotatably attached to the first bottom pincer claw at a first hinge so that the first top pincer claw and the first bottom pincer claw may be opened and closed relative to one another upon activation of the first pincer claw cylinder;

a second pair of pinching fingers comprising a second top pincer claw, a second bottom pincer claw and a second pincer claw cylinder connected to the second top pincer claw and the second bottom pincer claw, the second top pincer claw being rotatably attached to the second bottom pincer claw at a second hinge so that the second top pincer claw and the second bottom pincer claw may be opened and closed relative to one another upon activation of the second pincer claw cylinder;

the first pair of pinching fingers and the second pair of pinching fingers each have a width less than twelve inches;

the first top pincer claw includes a top claw plate located above the first pincer claw cylinder, the first pincer claw cylinder includes a rod exiting from a rod end of a hydraulic cylinder, the first pincer claw cylinder having a rod fully extended state, a rod fully retracted state, and a rod partially extended state, in both the rod fully extended state and the rod fully retracted state, the rod end positioned distant from the top claw plate, and in the rod partially extended state, the rod end positioned proximal to the top claw plate.

2. An implement capable of attachment to a utility vehicle having a first boom, a second boom, at least one lift cylinder for raising and lowering the booms and at least one coupler cylinder for rotating the implement forward and backward, the implement comprising:

a first pair of pinching fingers comprising a first top pincer claw, a first bottom pincer claw and a first pincer claw cylinder connected to the first top pincer claw and the first bottom pincer claw, the first pincer claw cylinder distant from both the first boom and the second boom, the first top pincer claw being rotatably attached to the first bottom pincer claw at a first hinge so that the first top pincer claw and the first bottom pincer claw may be opened and closed relative to one another upon activation of the first pincer claw cylinder;

a second pair of pinching fingers comprising a second top pincer claw, a second bottom pincer claw and a second pincer claw cylinder connected to the second top pincer claw and the second bottom pincer claw, the second top pincer claw being rotatably attached to the second bottom pincer claw at a second hinge so that the second top pincer claw and the second bottom pincer claw may be opened and closed relative to one another upon activation of the second pincer claw cylinder;

the first pair of pinching fingers and the second pair pinching fingers are spaced apart upon attachment to the utility vehicle with the space between the pinching fingers being substantially unobstructed to provide for clear visibility between the pinching fingers;

the first pair of pinching fingers and the second pair of pinching fingers each have a width less than twelve inches;

the first pincer claw cylinder rotatably connecting to the first bottom pincer claw at a cylinder hinge, the cylinder hinge located a first distance from the first hinge, and the first top pincer claw including a first claw plate having a substantially flat first interior surface, the first claw plate both connecting to and rotatable about the first hinge, the first claw plate having a corner section located at substantially the first distance from the first hinge, the corner section having a shape substantially defined by the cylinder hinge;

a second claw plate having substantially flat second interior surface, the second claw plate both connecting to and rotatable about the first hinge, a portion of the first interior surface connecting to a portion of the second interior surface; and the first pincer claw cylinder substantially located between the first interior surface and the second interior surface.

3. The implement of claim 1 further comprising a hydraulic control system connected to the first and second pincer claw cylinders so that the first and second pair of pinching fingers may be opened and closed in unison.

4. The implement of claim 3 wherein the first and second pincer claw cylinders are connected in series so that one of the pair of pinching fingers may continue to open or close when the other pair of pinching fingers is obstructed.

5. The implement of claim 1 further comprising a first hydraulic control system connected to the first pincer claw cylinder and a second hydraulic control system connected to the second pincer claw cylinder so that the first and second pair of pinching fingers may be opened and closed independently.

6. The implement of claim 2 further comprising a hydraulic control system connected to the first and second pincer claw cylinders so that the first and second pair of pinching fingers may be opened and closed in unison.

7. The implement of claim 6 wherein the first and second pincer claw cylinders are connected in series so that one of the pair of pinching fingers may continue to open or close when the other pair of pinching fingers is obstructed.

8. The implement of claim 1 further comprising a first stabilizer bar having a first end and a second end, the first end of the first stabilizer bar attached to the first top pincer claw and the second end of the first stabilizer bar attached to the second top pincer claw.

9. The implement of claim 2 further comprising a first stabilizer bar having a first end and a second end, the first end of the first stabilizer bar attached to the first bottom pincer claw and the second end of the first stabilizer bar attached to the second bottom pincer claw.

10. The implement of claim 9 further comprising a second stabilizer bar having a first end and a second end, the first end of the second stabilizer bar aft ached to the first top pincer claw and the second end of the second stabilizer bar attached to the second top pincer claw.

11. The implement of claim 2 further comprising a first stabilizer bar having a first end and a second end, the first end of the first stabilizer bar attached to the first top pincer claw and the second end of the first stabilizer bar attached to the second top pincer claw.

12. The implement of claim 1 further comprising the first pair of pinching fingers connecting to a first coupler cylinder on the utility vehicle;

the second pair of pinching fingers connecting to a second coupler cylinder on the utility vehicle; and the first pair of pinching fingers are distant from the second pair of pinching fingers.

13. The implement of claim 2 further comprising the first pair of pinching fingers connecting to a first coupler cylinder on the utility vehicle;

the second pair of pinching fingers connecting to a second coupler cylinder on the utility vehicle; and the first pair of pinching fingers are distant from the second pair of pinching fingers.

14. The implement of claim 4 further comprising the first pair of pinching fingers connecting to a first coupler cylinder on the utility vehicle;

the second pair of pinching fingers connecting to a second coupler cylinder on the utility vehicle; and the first pair of pinching fingers are distant from the second pair of pinching fingers.

15. The implement of claim 1 further comprising the first top pincer claw including a first claw plate connecting to the first pincer claw cylinder, and the first bottom pincer claw including a left tine and a right tine, wherein a portion of the first claw plate is located between the right tine and the left tine when the first pincer claw is fully closed.

16. The implement of claim 2 further comprising the first bottom pincer claw including a left tine and a right tine, wherein a portion of the first claw plate and a portion of the second claw plate are located between the right tine and the left tine when the first pincer claw is fully closed.

17. An implement capable of attachment to a utility vehicle having a first boom, a second boom, at least one lift cylinder for raising and lowering the booms and at least one coupler cylinder for rotating the implement forward and backward, the implement comprising:

a first pair of pinching fingers comprising a first top pincer claw, a first bottom pincer claw and a first pincer claw cylinder connected to the first top pincer claw and the first bottom pincer claw, the first pincer claw cylinder distant from both the first boom and the second boom, the first top pincer claw being rotatably attached to the first bottom pincer claw at a first hinge so that the first top pincer claw and the first bottom pincer claw may be opened and closed relative to one another upon activation of the first pincer claw cylinder;

a second pair of pinching fingers comprising a second top pincer claw, a second bottom pincer claw and a second pincer claw cylinder connected to the second top pincer claw and the second bottom pincer claw, the second top pincer claw being rotatably attached to the second bottom pincer claw at a second hinge so that the second top pincer claw and the second bottom pincer claw may be opened and closed relative to one another upon activation of the second pincer claw cylinder;

wherein the first pair of pinching fingers and the second pair pinching fingers are spaced apart upon attachment to the utility vehicle with the space between the pinching fingers being substantially unobstructed to provide for clear visibility between the pinching fingers;

a first hydraulic control system connected to the first pincer claw cylinder and a second hydraulic control system connected to the second pincer claw cylinder so that the first and second pair of pinching fingers may be opened and closed independently;

the first top pincer claw including a first claw plate having a substantially flat first interior surface, a second claw plate having a substantially flat second interior surface, both the first claw plate and the second claw plate rotatably attached to the first bottom pincer claw at the first hinge, a portion of the substantially flat first interior surface connecting to a portion of the substantially flat second interior surface;

the first pincer claw cylinder substantially located between the first interior surface and the second interior surface; and the first pincer claw cylinder rotatably connecting to the first bottom pincer claw at a cylinder hinge, the cylinder hinge located a first distance from the first hinge, and the first claw plate having a concave corner section located at substantially the first distance from the first hinge, the concave corner section having a curvature substantially defined by the cylinder hinge.

18. An implement capable of attachment to a utility vehicle having a first boom, a second boom, at least one lift cylinder for raising and lowering the booms and at least one coupler cylinder for rotating the implement forward and backward, the implement comprising:

a first pair of pinching fingers comprising a first top pincer claw, a first bottom pincer claw and a first pincer claw cylinder connected to the first top pincer claw and the first bottom pincer claw, the first pincer claw cylinder distant from both the first boom and the second boom, the first top pincer claw being rotatably attached to the first bottom pincer claw at a first hinge so that the first top pincer claw and the first bottom pincer claw may be opened and closed relative to one another upon activation of the first pincer claw cylinder;

a second pair of pinching fingers comprising a second top pincer claw, a second bottom pincer claw and a second pincer claw cylinder connected to the second top pincer claw and the second bottom pincer claw, the second top pincer claw being rotatably attached to the second bottom pincer claw at a second hinge so that the second top pincer claw and the second bottom pincer claw may be opened and closed relative to one another upon activation of the second pincer claw cylinder;

a first stabilizer bar having a first end and a second end, the first end of the first stabilizer bar attached to the first bottom pincer claw and the second end of the first stabilizer bar attached to the second bottom pincer claw;

the first top pincer claw including a first claw plate having a substantially flat first interior surface, the first claw plate both connecting to and rotatable about the first hinge;

a second claw plate having a substantially flat second interior surface, the second claw plate both connecting to and rotatable about the first hinge;

a portion of the first interior surface connecting to a portion of the second interior surface;

the first pincer claw cylinder substantially located between the first interior surface and the second interior surface, the first pincer claw cylinder rotatably connecting to the first bottom pincer claw at a cylinder hinge, the cylinder hinge located a first distance from the first hinge; and the first claw plate having a corner section located at substantially the first distance from the first hinge, the corner section having a shape substantially defined by the cylinder hinge.

19. The implement of claim 18 further comprising a second stabilizer bar having a first end and a second end, the first end of the second stabilizer bar attached to the first top pincer claw and the second end of the second stabilizer bar attached to the second top pincer claw.

* * * * *